United States Patent [19]

Hausner

[11] Patent Number: 4,763,850

[45] Date of Patent: Aug. 16, 1988

[54] EXPANDABLE WINDING MANDREL FOR RETAINING A SUBSTANTIALLY CYLINDRICAL YARN HOLDER OF A SPINNING OR TWISTING MACHINE

[75] Inventor: Gerhard Hausner, Albershausen, Fed. Rep. of Germany

[73] Assignee: Zinser Textilmaschinen GmbH, Ebersbach/Fils, Fed. Rep. of Germany

[21] Appl. No.: 58,328

[22] Filed: Jun. 4, 1987

[30] Foreign Application Priority Data

Aug. 5, 1986 [DE] Fed. Rep. of Germany ..... 3618918

[51] Int. Cl.[4] ..... B65H 54/54

[52] U.S. Cl. ..... 242/46.4; 242/72 R

[58] Field of Search ..... 242/46.2, 46.21, 46.3, 242/46.4, 46.6, 18 G, 72, 68.2, 68.3, 110, 110.1, 110.2, 115, 127; 269/48.1; 279/2 R

[56] References Cited

U.S. PATENT DOCUMENTS

| | | | |
|---|---|---|---|
| 747,406 | 12/1903 | Foster | 242/46.3 |
| 766,459 | 8/1904 | Moxham | 242/72 |
| 1,000,261 | 8/1911 | Hansen | 242/72 |
| 1,093,284 | 4/1914 | Mehlum | 242/72 |
| 1,259,165 | 3/1918 | Sundh | 242/72 X |
| 1,322,944 | 11/1919 | Pierce | 242/72 |
| 1,337,017 | 4/1920 | Kenworthy | 242/72 |
| 1,964,585 | 6/1934 | Larsen | 242/46.2 X |
| 2,204,475 | 6/1940 | Crandall | 242/72 X |
| 2,335,602 | 11/1943 | Nash et al. | 242/72 |
| 2,416,785 | 3/1947 | Welch | 242/46.2 X |
| 2,635,829 | 4/1953 | Carroll . | |
| 2,682,924 | 7/1954 | Lomazzo . | |
| 2,711,862 | 6/1955 | Herr | 242/72 |
| 2,762,577 | 9/1956 | Herr | 242/72 |
| 2,922,592 | 1/1960 | Kaltenbach . | |
| 4,061,289 | 12/1977 | Miura et al. | 242/72 X |
| 4,485,987 | 12/1984 | Simpson . | |

FOREIGN PATENT DOCUMENTS

| | | |
|---|---|---|
| 6945314 | 3/1970 | Fed. Rep. of Germany . |
| 3229036 | 5/1984 | Fed. Rep. of Germany . |
| 2544053 | 10/1984 | Fed. Rep. of Germany . |

*Primary Examiner*—Stanley N. Gilreath
*Attorney, Agent, or Firm*—Herbert Dubno

[57] ABSTRACT

The winding mandrels for expanding the substantially cylindrical thin walled yarn holders of a spinning or winding machine each have a plurality of gripping pieces distributed approximately uniformly about their circumference. The gripping pieces are each pivotable on a pivot axis transverse to the longitudinal axis of the winding mandrel supported in a bearing member of the winding mandrel. The gripping pieces are connected with slidable pushing members distributed as a group coaxially around the longitudinal axis of the winding mandrel by linking members movable over dead points and the pushing members are slidable jointly by at least one pushing device.

16 Claims, 1 Drawing Sheet

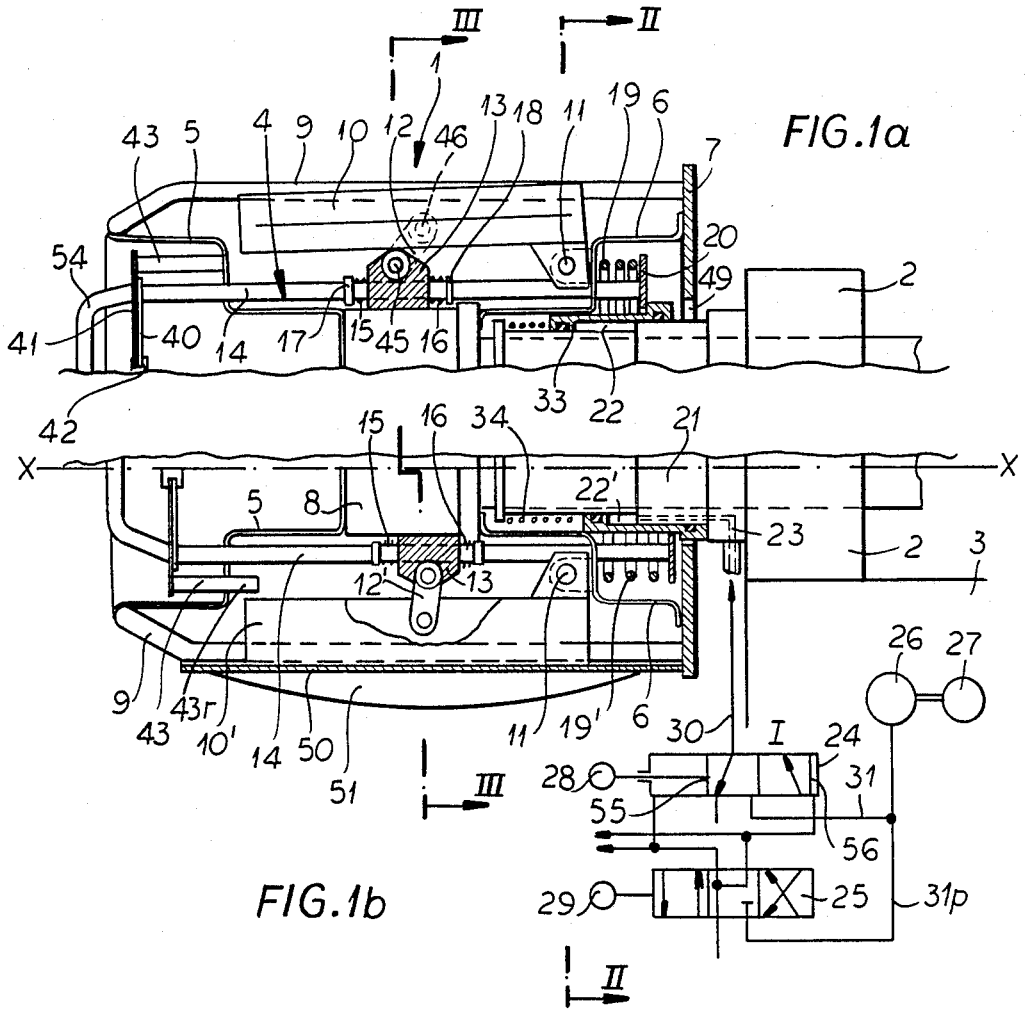
FIG.1a
FIG.1b
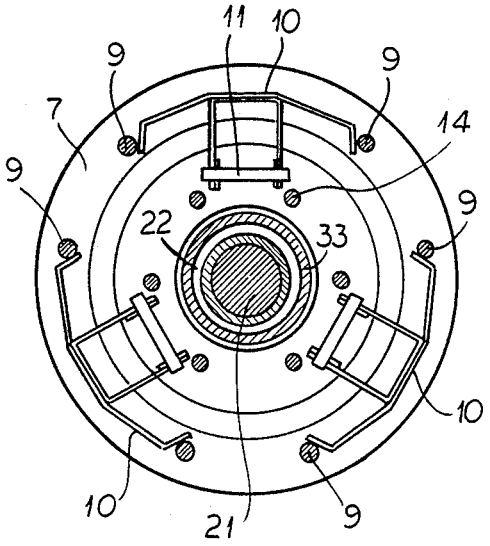
FIG.2
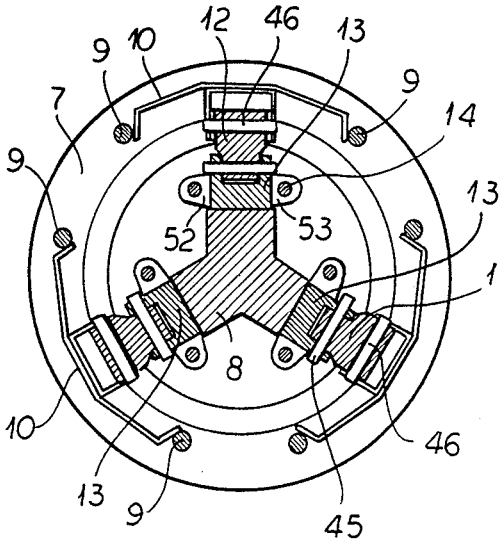
FIG.3

EXPANDABLE WINDING MANDREL FOR RETAINING A SUBSTANTIALLY CYLINDRICAL YARN HOLDER OF A SPINNING OR TWISTING MACHINE

FIELD OF THE INVENTION

My present invention relates to a spinning or twisting machine and, more particularly, to an expandable winding mandrel for internally seizing a substantially cylindrical yarn holder (spool or tube) of a twisting machine.

BACKGROUND OF THE INVENTION

An expandable winding mandrel for internally seizing a substantially cylindrical thin walled yarn holder of a spinning or twisting machine can have gripping segments or members distributed approximately uniformly around its circumference, i.e. in angularly equispaced relationship about an axis.

Receiving bobbins of winding holders with large inner diameters are mounted in certain spinning machines, e.g. glass fiber twisting machines, for processing synthetic fibers.

These winding holders have an inner diameter of, for example, 250 mm and are made of comparatively thin pasteboard.

It is a disadvantage that these winding supports are, for the most part, not exactly cylindrical and moreover do not have a shape which has sufficient stability. When they rotate moreover in the operating state their mounting on the winding mandrel is not reliable, being afflicted with position error and being otherwise problematical.

The gripping mechanism of the winding mandrels should be operable easily. They should be easily operable individually manually. It should also be possible to install a centrally operable mechanism on all the expandable winding mandrels of a spinning or twisting machine. These devices shold not be positively operated under pressure of a pressurizing medium since the clamping force might fail during a pressure drop. The gripping mechanism should have a centering effect to avoid undesirable imbalance as a result of noncentral or nonaxial holding of the winding holder.

OBJECTS OF THE INVENTION

It is an object of my invention to provide an improved expanding expandable winding mandrel for internally seizing a substantially cylindrical yarn holder of a spinning or twisting machine which fulfills the desiderata set forth above and avoids problems of earlier expanding mandrels.

It is also an object of my invention to provide an improved expandable winding mandrel for internally seizing a substantially cylindrical yarn holder of a spinning or twisting machine whose clamping device can reliably clamp a yarn holder which is not very stable and is not entirely cylindrical.

It is another object of my invention to provide an improved expandable winding mandrel for internally seizing a substantially cylindrical yarn holder of a spinning machine in which the clamping devices of all the expandable winding mandrels can be operated either individually or jointly.

SUMMARY OF THE INVENTION

These objects and others which will become more readily apparent hereinafter are attained in accordance with my invention in an expandable winding mandrel for internally seizing a substantially cylindrical thin walled yarn holder of a spinning or twisting machine with a plurality of gripping members distributed approximately uniformly around its circumference.

According to my invention each of the gripping members is pivotally mounted on a respective pivot axis supported in a bearing member of the expandable winding mandrel running transverse to the longitudinal axis of the expandable winding mandrel.

The gripping members are connected by respective articulated links with a plurality of slidable pushing members distributed as a group coaxially with the longitudinal axis of the expandable winding mandrel by a plurality of linking members and movable past respective dead points.

The pushing members are slidable jointly by at least one pushing device.

My invention has the advantage that the winding supports are gripped by the gripping members correctly even when the winding supports or yarn holders are not entirely cylindrical and even when they do not have a stable shape.

The pushing device permits the gripping mechanisms of the expandable winding mandrel to be operated either individually or jointly.

According to a feature of the invention, the pushing device can be manually operable. The pushing device can, alternatively or in addition, be operable by a pressurized medium. The pushing devices of all of the expandable winding mandrels of the spinning or twisting machine can be advantageously jointly operable.

In a particular embodiment of my invention the pivot axes are mounted in the bearing member on the end of the expandable winding mandrel opposite the front end of the expandable winding mandrel.

A plurality of substantially parallel pushing member rods distributed around the circumference in the bearing member are advantageously supported so as to be longitudinally movable and each of the pushing members is guided slidably on at least one of the pushing member rods.

Two pushing member rods can support one pushing member.

Each pushing member can be guided on the pushing member rod or the pushing member rods while being acted upon by a pushing member spring on each side of it.

Advantageously a pushing member rod spring holding the pushing member in the beyond-dead center position can be positioned between each of the pushing member rods and the bearing member.

All of the pushing member rods can be attached at one end with a rear pushing rod disk against which the pushing member rod spring is braced and which contacts on a shoulder of a piston of a piston cylinder unit slidable in a direction parallel to the longitudinal axis of the expandable winding mandrel.

The front ends of all the pushing rod members can be connected with a front pushing rod disk which, for its part, is connected with a retaining disk rotatable about the longitudinal axis of the expandable winding mandrel and braceable against the bearing member with inwardly directed retaining pins.

Advantageously, joint mandrel control is possible and the pistons of the piston cylinder units are acted on on one side by a piston spring and on the other side by a pressurized medium. The piston cylinder unit can be associated with or controlled by a manually operable three-way valve. The three-way valves can be also jointly operable. The three-way valves can be operable by the pressurized medium and can be associated with or controlled by a common controlling four-way valve.

BRIEF DESCRIPTION OF THE DRAWING

The above and other objects, features and advantages of my invention will become more readily apparent from the following description, reference being made to the accompanying highly diagrammatic drawing in which:

FIGS. 1*a* and 1*b* are partial side elevational views of a expandable winding mandrel for a yarn holder according to my invention in which FIG. 1*a* shows the gripping members disengaged and FIG. 1*b* shows the gripping members engaged in a gripping configuration, the mandrel being illustrated in conjunction with a schematic diagram of a connected valve system for remote operation of a group of expandable winding mandrels using a pressurized medium;

FIG. 2 is a cross sectional view taken along the section line II—II of FIGS. 1*a* and 1*b*; and FIG. 3 is a cross sectional view through the expandable winding mandrel of FIGS. 1*a* and 1*b* taken along the section line III—III thereof.

SPECIFIC DESCRIPTION

The expandable winding mandrel 1 shown in FIGS. 1*a*, 1*b*, 2 and 3 is mounted on a supporting member 2 of a not-illustrated spinning machine.

This spinning machine has a large number of these expandable winding mandrels 1.

Each expandable winding mandrel 1 has a bearing member 4, a front stepped bearing sleeve 5, a rear stepped bearing sleeve 6 and an intermediate member 8 positioned between them. The rear bearing sleeve 6 is mounted on a supporting disk 7 which is provided with a central opening 49. The bearing member 4 with the front bearing sleeve 5, the rear bearing sleeve 6 and the intermediate member 8 are positioned coaxially with the longitudinal axis X—X of the expandable winding mandrel 1.

From FIGS. 1*a*, 1*b* and 2 it is apparent that pivot axes 11 on which the pivotable gripping members 10 are supported are mounted in the rear bearing sleeve 6 of the bearing member 4 transverse to the longitudinal axis X—X of the expandable winding mandrel 1.

As FIG. 2 shows, three gripping members 10 are distributed approximately uniformly about the circumference of the expandable winding mandrel.

Running guides 9 are located between these gripping members 10.

These running guides 9 provide lateral guidance for the respective gripping members 10 as shown in FIG. 2 and are rigidly attached to the supporting disk 7 of the expandable winding mandrel 1. The gripping members 10 are connected with respective slidable pushing members 13 distributed as a group coaxially about the longitudinal axis X—X of the expandable winding mandrel 1 spaced from their pivot axes 11 by linking members 12.

These pushing members 13 slide according to FIG. 3 with their plane surfaces on planar opposing surfaces of the intermediate member 8. According to FIG. 3 three opposing surfaces are provided on the intermediate member distributed about its circumference. A respective pushing member 13 slides on each of these opposing surfaces.

Each pushing member 13 is guided on pushing member rods 14 by flanges 52 and 53 seen in FIG. 3. These pushing member rods 14 extend over the entire length of the expandable winding mandrel 1 and are distributed in a pattern which is coaxial with longitudinal axis X—X, but are radially spaced therefrom.

The pushing member rods 14 are attached to a rear pushing rod disk 20 at their rear ends.

A compressible pushing member rod spring 19 surrounds the pushing member rod 14 between this rear pushing rod disk 20 and the interior side of the rear bearing sleeve 6 of the bearing member 4.

On their front ends the pushing member rods 14 are jointly attached with a front pushing rod disk 40 which is connected with a retaining disk 41 by a hub 42.

The retaining disk 41 can rotate on the hub 42. The retaining disk 41 has retaining pins 43 which according to the rotational position of the disk 41 can be forced through holes or recesses 43*r* in the front bearing sleeve 5 and thus permit a motion to the right or support themselves on the inside surface of the front bearing sleeve 5. This support is shown in FIG. 1*a*, while the forcing of the retaining pins 43 into the recess 43*r* in the front bearing sleeve 5 is apparent in FIG. 1*b*.

The linking members 12 of the gripping members 10 are such that they can be moved out over their dead center positions by motion of their pushing members 13 so that a released or gripping configuration can be obtained by pivoting the gripping members 10 about the pivot axes 11.

The linking members 12 are located in front of their dead points in FIG. 1*a* (corresponding to the sectional plane III—III) so that the gripping members 10 themselves are positioned in the released configuration and thus are set back under the envelope of the running guides 9.

The linking members 12' in FIG. 1*b* are moved beyond their dead center positions. The gripping members 10 are positioned in the gripping configuration set out beyond the periphery of the running guides 9 and thus engage a yarn holder 50 which is provided with a winding surface 51. It sits under the load of the compressible pushing rod member springs 19 which holds it in the position corresponding to the beyond-dead center position of the linking members 12. In this position the pushing members 13 contact on a collar or flange of the intermediate member 8.

As is apparent from FIGS. 1*a* and 1*b* pushing member springs 15 and 16 are provided on both sides of each pushing member 13 and support themselves against a flange 17 and a flange 18 of the pushing member rods 15. Thus an elastic gripping of the thin walled yarn holder 50 is guaranteed.

To manually clamp the yarn holder, i.e. to move the gripping members 10 from the position shown in FIG. 1*a* to the position shown in FIG. 1*b* the retaining disk 41 is rotated by a hand grip 54 until the retaining pins 43 no longer can be supported on the inner wall of the front bearing sleeve 5 but can penetrate through the recesses 43*r* in this bearing sleeve 5 according to FIG. 1*b*.

The pushing member rod spring 19 travels from the released to the gripping position 19' and takes along all the pushing member rods 14 by the rear pushing rod disk 20 which thus execute a motion from left to right.

Thus the pushing members 13 are moved from the left to right also and swing the gripping members 10 about the pivot axes 11 by the linking members 12 from the released position into the extended gripping position. Thus it is possible to operate each individual expandable winding mandrel 1 manually so that the gripping members can be shifted from the released configuration to the gripping configuration.

Instead of the above described manual operation or in addition thereto each expandable winding mandrel 1 in regard to its gripping members can be shifted into the released configuration and/or into the gripping configuration.

Thus the rear pushing rod disk 20 is connected at a shoulder with a piston 33 of a piston cylinder unit. This piston 33 rides on a pin 21. Between the front portion of this pin 21 and the inner wall of the piston 33 a chamber 22 is formed which is connected by a duct 23 and a pipe 30 with a three-way valve 24 which is connected by a pipe 31 with a pump 26 and a motor 27.

If the three-way valve 24 is brought into position I in which it is connected with pipe 30 by a handle 28 a pressurized medium flows through the pipe 30 and the duct 23 into a chamber 22' with a volume which is small enough that the pushing member rods 14 can be shifted from the position according to FIG. 1*b* to the position according to FIG. 1*a* by the piston 33 acting on the rear pushing rod disk spring 34 and thus the rear pushing rod disk 20. In the position according to FIG. 1*a* the springs 19 and 34 are pushed toward each other or compressed. The gripping members 10 are shifted from the gripping configuration into the released configuration by the pushing members 13 and the linking members 12, 12' so that the yarn holder 50 can be pulled from the expandable winding mandrel 1.

When the three-way valve 24 goes back into the position shown in FIG. 1*b* the pressurized medium flows out under action of the springs 19 and 34 through the duct 23 and the pipe 30 and as previously described a shift of the gripping members from the released configuration according to FIG. 1*a* to the gripping configuration according to FIG. 1*b* occurs.

A three-way valve 24 is associated with each expandable winding mandrel 1 so that the gripping device of each expandable winding mandrel is individually operable.

According to my invention all of the three-way valves can be connected to a common four-way valve 25 which can be used to centrally grip or release all the gripping members of all the expandable winding mandrels of a spinning machine. This four-way valve can take three positions.

This four-way valve is connected by pipes 31*p* with pump 26 and motor 27. Both front faces 55 and 56 of the three-way valves 24 performing as pistons are acted upon.

In the central position of the four-way valve 25 shown in FIGS. 1*a* and 1*b* the front faces 55 and 56 of the three-way valve 24 are relieved from pressure and thus can be operated by hand by the handle 28.

By operation of the handle 29 which is part of the four-way valve 25, this valve can be moved into its extreme position whereby all three-way valves 24 of the spinning machine can be moved jointly into positions which permit their piston cylinder units and the pistons 33 to release or extend the gripping members 10.

By the pushing device mentioned in the summary and the claims I mean the pushing member rods 14, the pushing member springs 15 and 16, the pushing rod disk 20, the retaining pins 43 and recesses 43*r* and any other parts which cause or assist in moving the pushing members 13.

I claim:

1. An expandable yarn-winding mandrel for releasable internal engagement of a substantially cylindrical, thin-wall yarn holder of a spinning or twisting machine, comprising:

a support surrounding an axis of rotation and rotatable therearound;

a plurality of elongated gripping members angularly spaced about said axis and each pivotally mounted at one end on said support for swinging movement about respective pivot axes transverse to said axis of rotation between outer operative positions of said gripping members wherein said yarn holder is internally seized by said gripping members and inner operative positions wherein said yarn holder is freed to be withdrawn from said mandrel;

a plurality of axially shiftable pushing members each assigned to a respective one of said gripping members mounted on said support and disposed in an array coaxial with said axis of rotation and radially spaced therefrom;

respective links connecting each of said pushing members with a respective one of said gripping members and displaceable past respective deadcenter positions for shifting said gripping members between said operative positions thereof so that each link has positions to opposite sides of the respective deadcenter position corresponding to the said operative positions of the respective gripping member; and a pushing device operatively connected to all of said pushing members for axially shifting said pushing members jointly to displace said pushing members and swing said gripping members about said pivot axes between said operative positions.

2. The expandable yarn-winding mandrel defined in claim 1 wherein said pushing device includes a manually operable member for displacing said pushing members.

3. The expandable yarn-winding mandrel defined in claim 1 wherein said pushing device includes means forming a fluid-pressure cylinder and piston operable by a fluid medium for displacing said pushing members.

4. The expandable yarn-winding mandrel defined in claim 1 wherein said mandrel is one of a multiplicity of said mandrels in said machine, further comprising means for jointly operating all of said pushing devices of said mandrels.

5. The expandable yarn-winding mandrel defined in claim 1 wherein said mandrel has a front end at which said yarn holder is removed from said mandrel and inserted onto said mandrel, said pivot axes being located at ends of said gripping members opposite said front end of the mandrel.

6. The expandable yarn-winding mandrel defined in claim 5 wherein said pushing device includes:

a plurality of pushing rods disposed in an array surrounding said axis of rotation and parallel thereto, each of said pushing members being guided on at least one of said rods, said rods being axially shiftable on said support.

7. The expandable yarn-winding mandrel defined in claim 6 wherein each of said pushing members is supported and guided on a respective pair of said rods.

8. The expandable yarn-winding mandrel defined in claim 6 wherein said pushing device further comprises:

a pair of springs on each of said rods flanking the respective pushing member and bearing axially in opposite directions thereon, each pushing member being slidable on the respective rod.

9. The expandable yarn-winding mandrel defined in claim 8 wherein said pushing device further comprises:

a disk interconnecting all of said rods at an end of said mandrel opposite said front end; and a spring braced between said support and said disk for retaining said links in beyond-deadcenter positions corresponding to outer operative positions of said gripping members.

10. The expandable yarn-winding mandrel defined in claim 9 wherein said pushing device further comprises:

a further disk connecting all of said rods at said front end of said mandrel; and a plurality of pins on said further disk for supporting said further disk upon said support to retain in a stressed condition the spring braced between said support and said disk until relative rotation of said further disk and said support permits said pins to pass through holes formed in said support.

11. The expandable yarn-winding mandrel defined in claim 9 wherein said pushing device further comprises:

a fluid-operated piston/cylinder unit acting upon said disk.

12. The expandable yarn-winding mandrel defined in claim 11 wherein said piston/cylinder unit has a piston slidable in a cylinder and acting upon said disk to displace said disk axially, a piston spring acting upon said piston in one axial direction and a fluid chamber formed between said piston and said cylinder and pressurizable to urge said piston in an opposite axial direction.

13. The expandable yarn-winding mandrel defined in claim 12, further comprising a three-way valve connected with said piston/cylinder unit.

14. The expandable yarn-winding mandrel defined in claim 13 wherein said mandrel is one of a multiplicity of said mandrels in said machine, each of said mandrels has a respective said piston/cylinder unit and a respective said three-way valve, and said pushing device further comprises:

means for jointly operating all of said three-way valves.

15. The expandable yarn-winding mandrel defined in claim 14 wherein said means for jointly operating all of said three-way valves includes a common four-way control valve connected with said three-way valves.

16. A expandable winding mandrel for internally seizing a substantially cylindrical thin walled yarn holder of a spinning or twisting machine comprising:

a bearing member;

a plurality of gripping members distributed approximately uniformly around the circumference of said expandable winding mandrel, said gripping members being each pivotally mounted on a pivot axis supported in said bearing member of said expandable winding mandrel transverse to the longitudinal axis of said expandable winding mandrel on the opposite end from the front end of said expandable winding mandrel;

a plurality of slidable pushing members connected with said gripping members distributed as a group coaxially spaced from said longitudinal axis of said expandable winding mandrel by a plurality of linking members movable over dead points;

at least one pushing device for axially sliding said pushing members jointly comprising a plurality of substantially parallel pushing member rods distributed around said circumference in said bearing member supported longitudinally movable, each of said pushing members being guided slidably on two of said pushing member rods, a pushing member spring on each side of said pushing member acting on said pushing member and a pushing member rod spring positioned between each of said pushing member rods and said bearing member which can hold said pushing member in the over-dead-point position, a front pushing rod disk attached to the front ends of all of said pushing member rods which for its part is connected with a retaining disk rotatable about said longitudinal axis of said expandable winding mandrel and bracable against said bearing member with a plurality of retaining pins, and a rear pushing rod disk attached at the rear ends of all of said pushing member rods against which said pushing member rod spring is braced and which contacts on a shoulder of a piston of a piston cylinder unit slidable in a direction parallel to said longitudinal axis of said expandable winding mandrel, said piston of said piston cylinder unit being acted on on one side by a piston spring and on the other side by a pressurized medium, a manually operable three-way valve associated with each of said piston cylinder units for operation of said expandable winding mandrel structured so that all of said expandable winding mandrels of said spinning or twisting machine are jointly operable, and a common four-way valve for controlling each of said three-way valves for said spinning or twisting machine using said pressurized medium.

* * * * *